United States Patent [19]

Imazu

[11] Patent Number: 4,988,227

[45] Date of Patent: Jan. 29, 1991

[54] WRITING MEANS

[75] Inventor: Ryuzo Imazu, Osaka, Japan

[73] Assignee: Fuji Sangyo Co., Ltd., Osaka, Japan

[21] Appl. No.: 284,503

[22] Filed: Dec. 14, 1988

[30] Foreign Application Priority Data

Dec. 28, 1987 [JP] Japan ..... 62-335266

[51] Int. Cl.[5] ..... B43K 7/02

[52] U.S. Cl. ..... 401/117; 401/107; 401/213

[58] Field of Search ..... 401/117, 106, 107, 213

[56] References Cited

U.S. PATENT DOCUMENTS 2,416,112 2/1947 Moore ..... 401/106
3,992,115 11/1976 Culver ..... 401/106
4,653,949 3/1987 Larizza ..... 401/213

FOREIGN PATENT DOCUMENTS 60-91480 6/1985 Japan ..... 401/99

*Primary Examiner*—Richard J. Apley
*Assistant Examiner*—D. F. Crosby
*Attorney, Agent, or Firm*—Jordan and Hamburg

[57] ABSTRACT

Writing means using volatile ink, aqueous ink or the like writing comprises: a cylindrical body; a writing unit disposed at the lower surface of the body; and a cylindrical closing member rotatably and vertically movably attached to the lower end of the body. The writing unit includes an ink tank and a pen tip attached to the ink tank. The closing member is provided at the lower surface thereof with a cap unit for hermetically covering the pen tip and with a through-hole in which the pen tip is vertically movable. The rotation and vertical movement of the closing member with respect to the body selectively provides two states, i.e., one state where the pen tip is hermetically covered with the cap unit, and the other state where the pen tip projects from the pen-tip hole. Thus, according to the writing means of the present invention, the manipulation is simple, and there is no possibility that the ink is erroneously evaporated or the cap is lost. Further, since the pen tip is hermetically covered with the cap unit, the body inside is not required to have a complicated sealing structure.

5 Claims, 7 Drawing Sheets

WRITING MEANS

BACKGROUND OF THE INVENTION

The present invention relates to writing means using volatile ink, aqueous ink or the like.

A conventional writing means using volatile ink, aqueous ink or the like is arranged such that the pen tip is covered with a cap separate from the body of the writing means, thereby to prevent the ink from being evaporated. Such cap-type writing means presents the problems that a failure to put the cap on causes the ink to be evaporated and the cap may be lost.

To solve such problems, there has been proposed writing means in which the body thereof having a pen-tip hole is provided inside thereof with a pen-tip hole closing member and with a writing unit including an ink tank and a pen tip (Japanese Utility Model Laid-Open Publication No. 60-91480).

In such writing means, the closing member and the writing unit are alternately housed inside of the body. This causes the body to be complicated in inside structure. Further, there are instances where the pen-tip hole is not fully closed by the closing member. Moreover, such writing means presents the problem that the ink is evaporated unless the body has a perfect inside sealing structure.

SUMMARY OF THE INVENTION

It is an object of the present invention to overcome the problems above-mentioned by providing writing means in which the body thereof is formed integrally with a cap for hermetically covering the pen tip.

The writing means in accordance with the present invention comprises: a cylindrical body; a writing unit disposed at the lower surface of the body; and a cylindrical closing member rotatably and vertically movably attached to the lower end of the body. The writing unit includes an ink tank and a pen tip attached thereto. The closing member is provided at the lower surface thereof with a cap unit for hermetically covering the pen tip and with a through-hole in which the pen tip is retractable or vertically movable. The rotation and vertical movement of the closing member with respect to the body selectively provides two states, i.e., one state where the pen tip is hermetically covered with the cap unit, and the other state where the pen tip projects from the pen-tip hole.

When the writing means above-mentioned is not in use, the cap unit in the closing member is left as hermetically covering the writing unit.

When the writing means is to be used, the closing member is rotated and vertically moved to release the cap unit from the writing unit, such that the writing unit projects from the pen-tip hole.

For covering the writing unit with the cap unit, the closing member may be again rotated and vertically moved.

According to the writing means of the present invention, a mere movement of the closing member enables the pen tip to be covered with the cap unit or to project from the pen-tip hole. Thus, the manipulation is simple, and there is no possibility that the ink is erroneously evaporated or the cap is lost. Further, since the pen tip is hermetically covered with the cap unit, the body inside is not required to have a complicate sealing structure.

BRIEF DESCRIPTION OF THE DRAWINGS

FIG. 1 is an exploded perspective view of the writing means;

FIG. 2 to FIG. 5 are longitudinal section views of a closing member, illustrating how it is successively slid;

FIG. 6 is a bottom view of the writing means;

FIG. 7 is a section view taken along the line II—II in FIG. 2;

FIG. 8 is a section view taken along the line III—III in FIG. 2;

FIG. 9 is a developed view of the outer peripheral surface of the closing member;

FIG. 10 is a developed view of a groove in the outer peripheral surface of a writing unit;

DETAILED DESCRIPTION OF THE PREFERRED EMBODIMENTS

Figure 1:
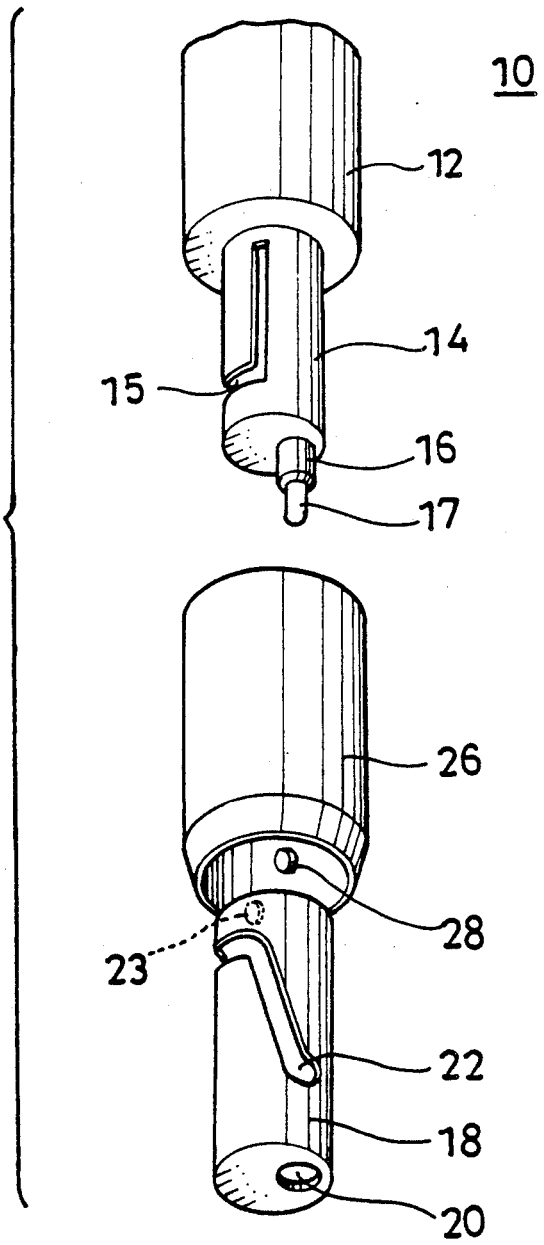
FIG. 1 to FIG. 10 are views of writing means in accordance with a first embodiment of the present invention.
Figure 4:
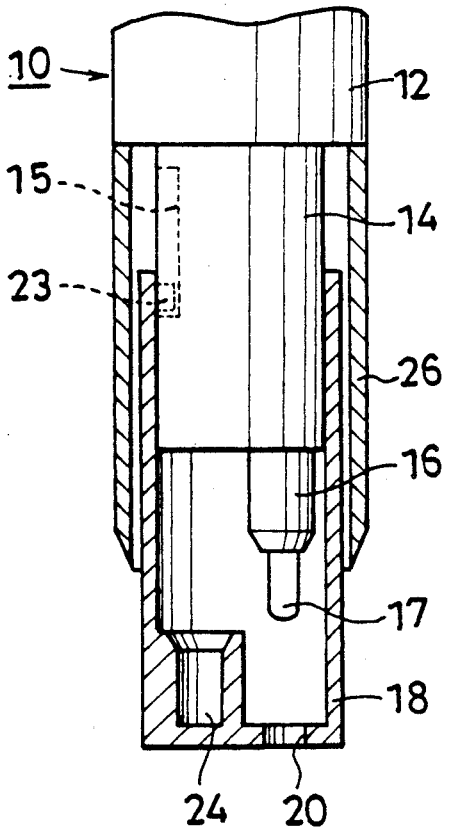

FIG. 1 to FIG. 10 are views of writing means in accordance with a first embodiment of the present invention.

Writing means 10 of the present invention comprises a cylindrical body 12, a cylindrical writing unit 14 and a cylindrical closing member 18.

The writing unit 14 has a diameter smaller than that of the body 12, and projects from the lower surface of the body 12. The writing unit 14 houses volatile ink. A holding member 16 holds a pen tip 17, and projects from the lower surface of the writing unit 14 at a position eccentric with respect to the axis of the writing unit 14. The holding member 16 has a tapering lower portion. The writing unit 14 is provided in the outer peripheral surface thereof with a substantially U-shape groove 15 (See FIG. 10).

The closing member 18 has a lower surface in which a pen-tip hole 20 is formed at a position eccentric with respect to the axis of the closing member 18. The writing unit 14 is rotatably and vertically movably inserted into the closing member 18 from the upper portion thereof. The closing member 18 is provided in the outer peripheral surface 19 with a substantially inverted V-shape groove 22 (See FIG. 9). The closing member 18 is provided on the lower portion of the inner peripheral surface thereof with a projection 23, which is fitted in the groove 15 in the writing unit 14.

Figure 2:
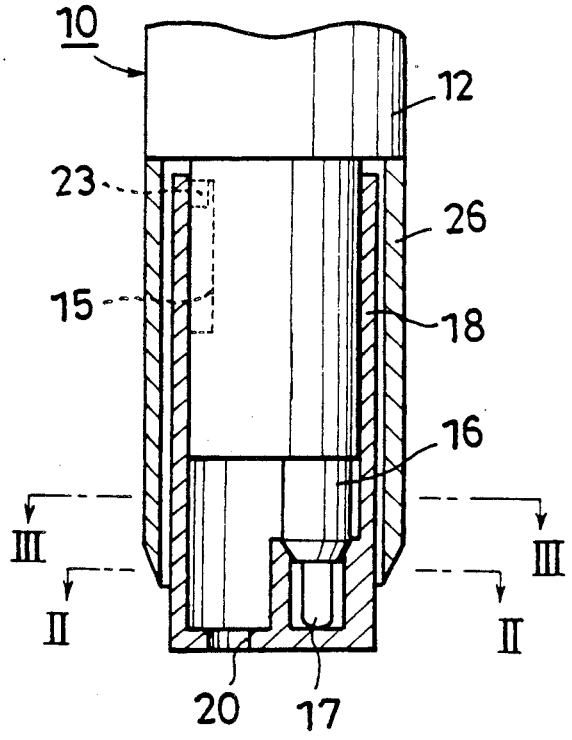
Figure 5:
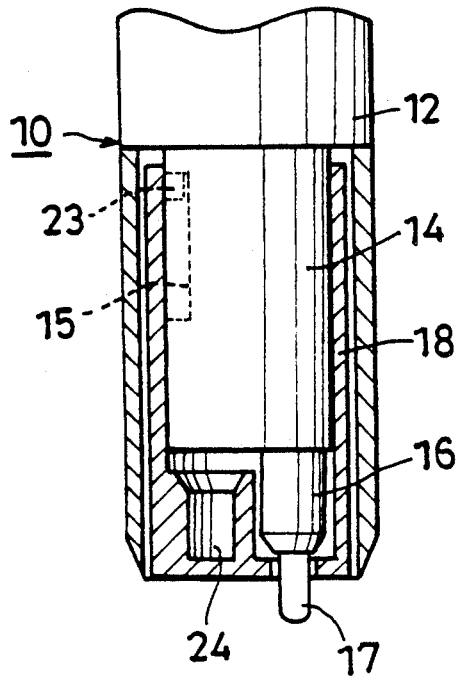
Figure 3:
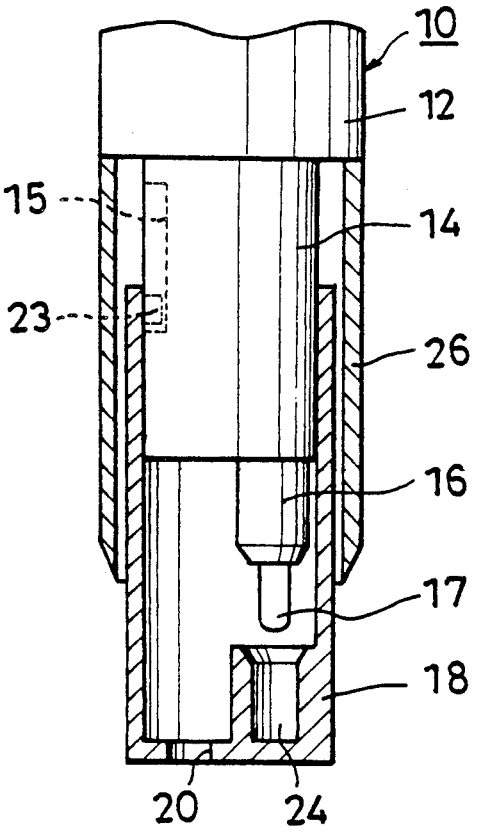
Figure 6:
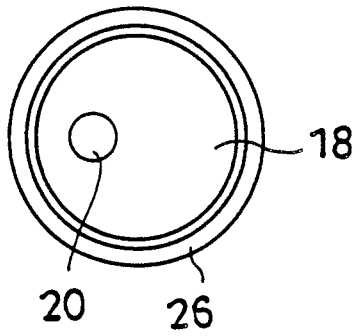
Figure 7:
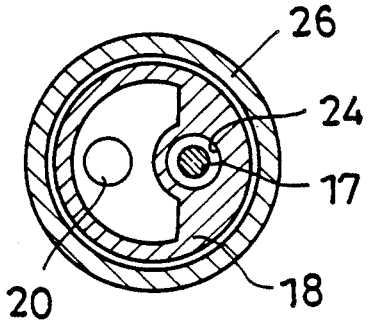
Figure 8:
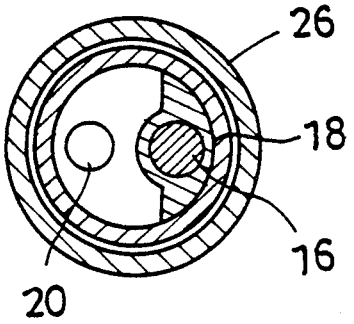

For hermetically covering the pen tip 17, a cylindrical cap unit 24 is disposed inside of the closing member 18 at the lower portion thereof (see FIG. 2). The cap unit 24 is located at the position which constitutes point symmetry with respect to a pen-tip hole 20 around the axis of the closing member 18 (See FIG. 7). The cap unit 24 has an opening of which the edge is tapered such that the opening receives the holding member 16 with a snug fit.

A cylindrical operating tube 26 having an open top and an open bottom, houses and is rotatable relative to the closing member 18. The operating tube 26 is provided in the inner peripheral surface thereof with a projection 28 fitted in the groove 22.

The following description will discuss the operation of the writing means 10 having the arrangement above-mentioned.

With reference to FIG. 2, the description will be first made of the state where the writing means 10 is not in use.

The cap unit 24 hermetically covers the pen tip 17 to prevent the ink from being evaporated. The projection 28 of the operating tube 26 is located in a position 28A in the groove 22 of the closing member 18 (See FIG. 9). The projection 23 of the closing member 18 is located in a position 23A in the groove 15 (See FIG. 10).

The description is now made of how the writing means 10 is operated from the state above-mentioned to the writing state.

When the operating tube 26 is rotated by hand, the projection 28 causes the closing member 18 to be moved downward with respect to the body 12. More specifically, when the operating tube 26 is rotated, the relative position of the projection 28 with respect to the groove 22 is moved to a position 28B (See FIG. 9), while the relative position of the projection 23 with respect to the groove 15 is moved to a position 23B (See FIG. 10). This causes the closing member 18 to be lowered, thereby to release the cap unit 24 from the pen tip 17 (See FIG. 3).

Figure 9:
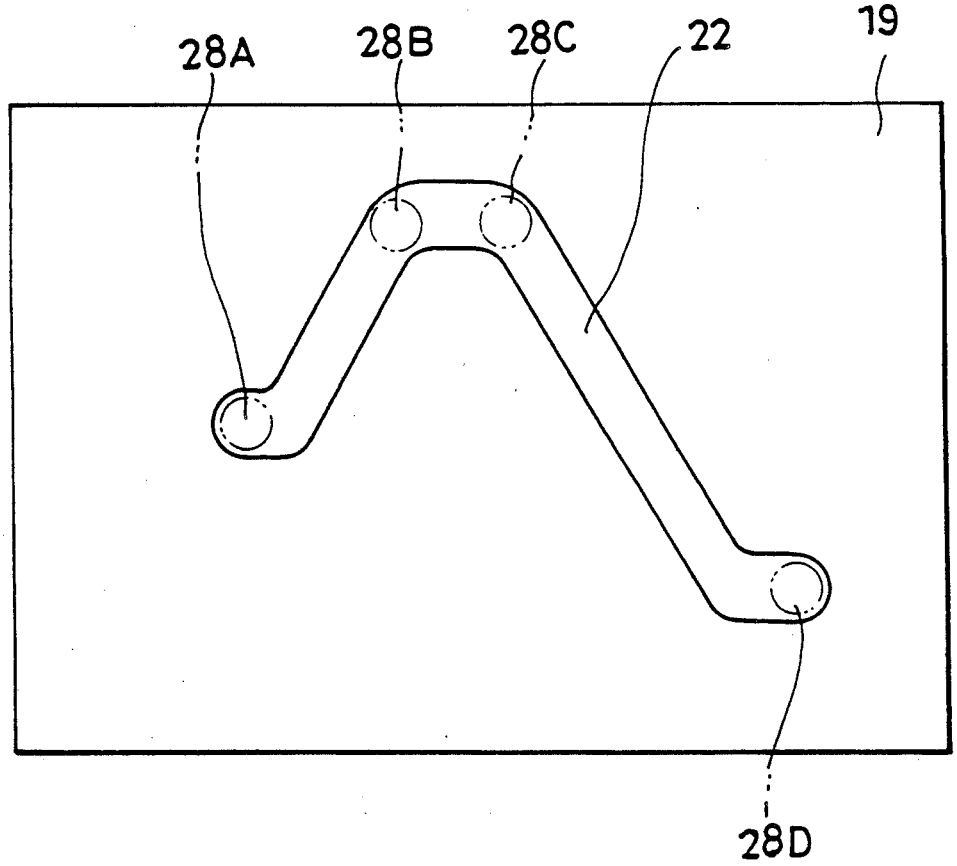

When the operating tube 26 is further rotated, the relative position of the projection 28 with respect to the groove 22 is moved to a position 28C (see FIG. 9). By further rotating the operating tube 26 together with the closing member 18, the relative position of the projection 23 with respect to the groove 15 is moved to a position 23C (See FIG. 10). This causes the pen-tip hole 20 to be so rotated as to be coaxial with the pen tip 17 (See FIG. 4).

Figure 10:
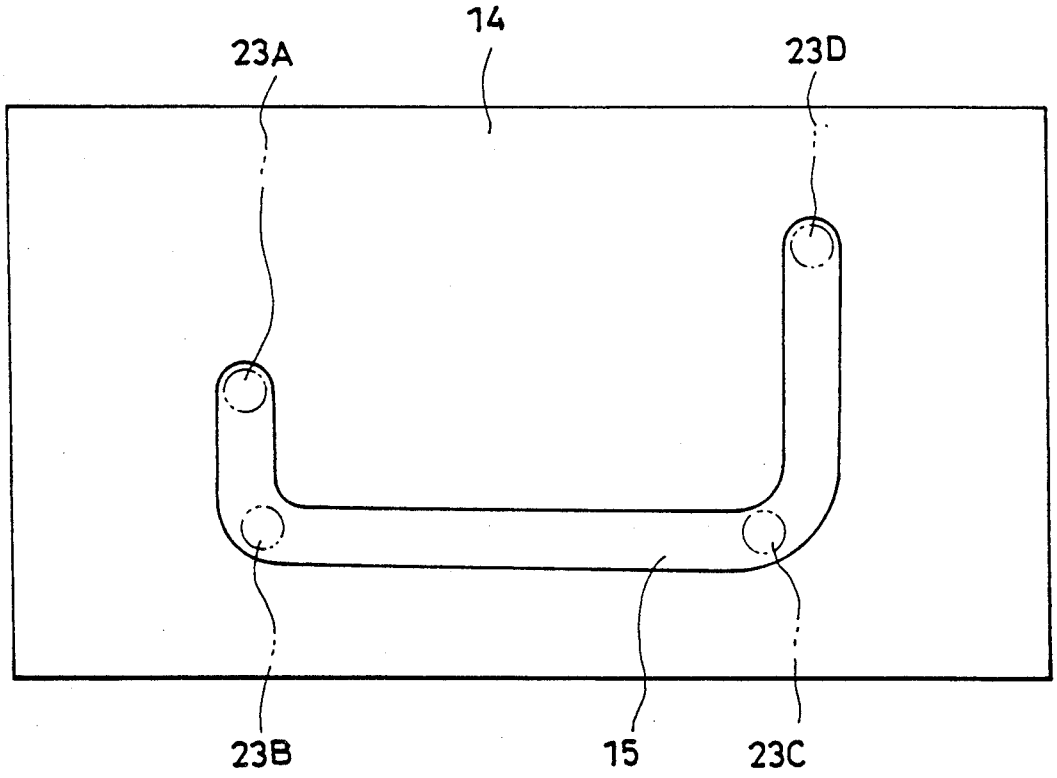

By rotating the operating tube 26, the relative position of the projection 28 with respect to the groove 22 is moved to a position 28D (See FIG. 9), while the relative position of the projection 23 with respect to the groove 15 is moved to a position 23D (See FIG. 10). This causes the closing member 18 to be moved upward such that the pen tip 17 projects from the pen-tip hole 20 (See FIG. 5).

After use of the writing means 10, the operating tube 26 is rotated in the reverse direction. This causes the pen tip 17 to be hermetically covered with the cap unit 24.

According to the writing means 10 having the arrangement above-mentioned, a mere rotation of the operating tube 26 enables the pen tip 17 to be covered with the cap unit 24 or to project from the pen-tip hole 20. Thus, there is no likelihood that the ink is erroneously evaporated or the cap is lost. Further, the inside of the body 12 need not to be hermetically sealed, requring no complicated inside structure.

In the embodiment above-mentioned, the lower portion of the holding member 16 and the opening edge of the cap unit 24 are tapered, but such arrangement is not necessarily required. For example, annular packing may be disposed at the lower portion of the holding member 16. In this case, when the pen tip is covered with the cap unit, the annular packing provides an airtight condition inside of the cap unit.

Figure 11:
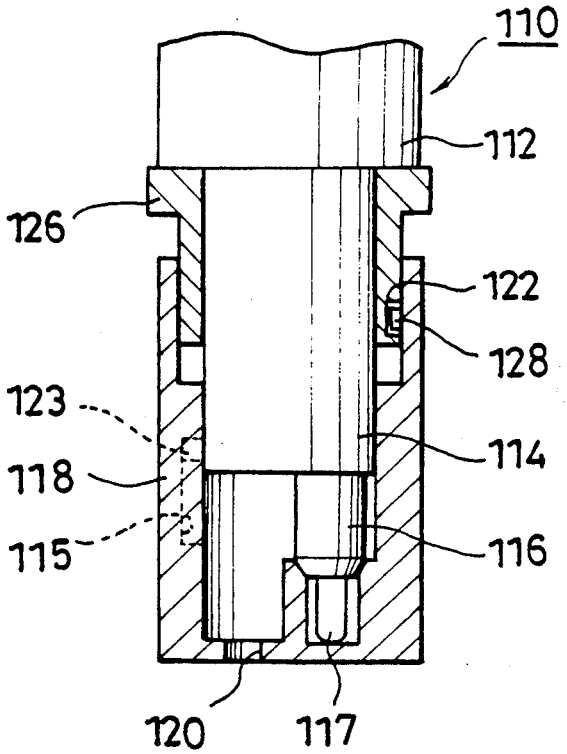
FIG. 11 and FIG. 12 are views of writing means in accordance with a second embodiment of the present invention.
Figure 12:
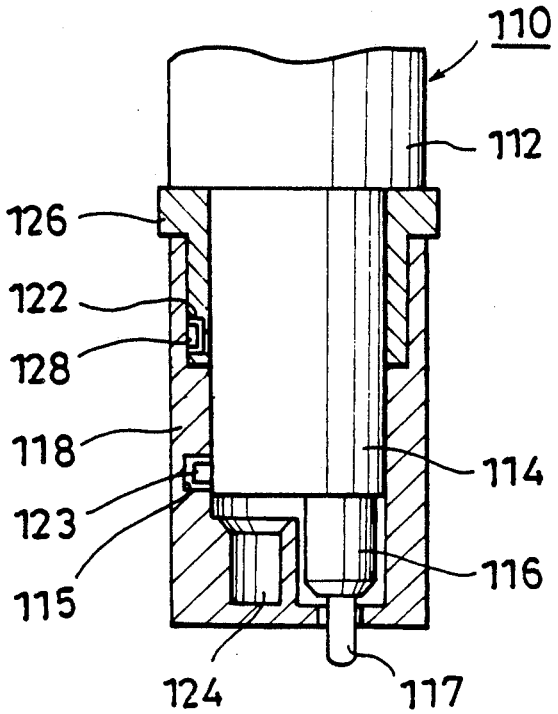

The following description will discuss writing means 110 in accordance with a second embodiment of the present invention with reference to FIG. 11 and FIG. 12.

In the second embodiment, like parts are designated by like numerals used in the drawings for the first embodiment, with 100 added thereto.

Writing means 114 is provided at the lower portion of the outer peripheral surface thereof with a projection 123.

A closing member 118 is provided on the inner peripheral surface thereof with a U-shape groove 115 engaged with the projection 123.

The closing member 118 has an upper portion for covering the lower portion of an operating tube 126. The closing member 118 is provided on the inner peripheral surface thereof with a projection 128. The operating tube 126 is provided in the outer peripheral surface of the lower portion thereof with a substantially V-shape groove 122, which is engaged with the projection 128.

The following description will discuss how the writing means 110 is operated from the state where the writing means 110 is not in use (See FIG. 11), to the state where the writing means 110 is in use (See FIG. 12).

By rotating the operating tube 126 with the hand, the projection 128 is moved along the groove 122 in the operating tube 126 while the projection 123 is moved along a groove 115 in the closing member 118. This causes the closing member 118 to be lowered, thereby to release a cap unit 124 from a pen tip 117.

When the closing member 118 is then rotated by the operating tube 126, a pen-tip hole 120 is so rotated as to be coaxial with the pen tip 117.

By lifting up the closing member 118 with the operating tube 126, the pen tip 117 is projected from the pen tip hole 120.

In the first and second embodiments, the cam mechanism constituted by the projection 28, 128 and the groove 22, 122 is arranged such that the closing member 18, 118 is rotated and vertically moved by rotating the operating tube 26, 126. Instead of the use of this cam mechanism, the closing member 18, 118 may be rotated and retracted by hand.

Figure 13:
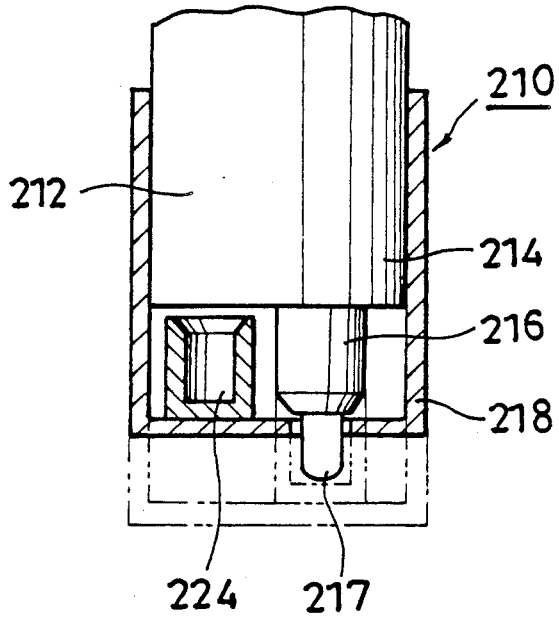
FIG. 13 is a longitudinal section view of writing means in accordance with a third embodiment of the present invention.

The following description will discuss writing means 210 in accordance with a third embodiment of the present invention, with reference to FIG. 13.

In the third embodiment, like parts are designated by like numerals used in the drawings for the first embodiment, with 200 added thereto.

When the writing means 210 is to be used, a pen tip 217 projects from a pen tip hole 220, and a cap unit 224 is located at the side of a writing unit 214 (See FIG. 13).

When the writing means 210 is not in use, a closing member 218 is moved downward to house the pen tip 217 therein. The cap unit 224 is so moved as to be coaxial with the pen tip 217 by a spring, a cam or the like. When the closing member 218 is moved up, the pen tip 217 is hermetically covered by the cap unit 224.

In FIG. 13, a pen-tip holding member 216 is disposed at a position eccentric with respect to the axis of the body of the writing unit 214.

Figure 14:
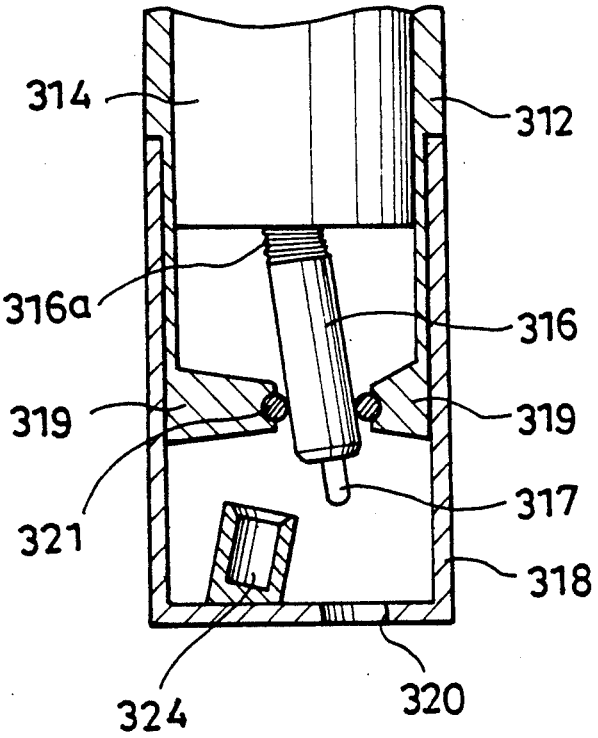
FIG. 14 is a longitudinal section view of writing means in accordance with a fourth embodiment of the present invention.

The following description will discuss writing means 310 in accordance with a fourth embodiment of the present invention, with reference to FIG. 14.

In the fourth embodiment, like parts are designated by like numerals used in the drawings for the first embodiment, with 300 added thereto.

A holding member 316 for holding a pen tip 317 is attached to a writing unit 314 through a connection unit 316*a* in the form of bellows or the like. The holding member 316 is supported by a support 319 projecting from the inner surface of a closing member 318 such that the holding member 316 is eccentric with respect to the axis of the body 312 of the writing means 310. Between the support 319 and the holding member 316, an annular ring 321 is disposed to assure a smooth movement of the holding member 316.

The writing means 310 is operated as outlined below.

When the body 312 is rotated with respect to the closing member 318, the writing unit 314 is vertically moved with respect to the closing member 318 by a cam or the like. This selectively provides two states, i.e., one state where the pen tip 317 projects from a pen-tip hole 320, and the other state where the pen tip 317 is hermetically covered by a cap unit 324.

In the embodiments above-mentioned, the writing unit using volatile ink is used. However, the present invention may also be embodied with the writing unit using aqueous ink.

What is claimed is:

1. A writing device comprising:

a cylindrical body having a surface at an axial extremity of the body which is transverse with respect to the axis of the body;

a writing unit disposed at said surface of said body;

a cylindrical closing member rotatably and axially movably disposed at said extremity of said body with the axis of said member being parallel to the axis of said body;

said writing unit including an ink tank and a pen tip attached to said ink tank, said closing member having a surface at an axial extremity thereof which is transverse with respect to the axis of the cylinder and is provided with a cap unit for hermetically covering said pen tip and with a through-hole through which said pen tip is movable, relative locations of the pen tip, cap member and through-hole being so selected that rotation of and axial movement of said closing member with respect to said body selectively provides two states, one of said states being where said pen tip is hermetically covered with said cap unit and the other of said states being where said pen tip projects through said through-hole; and an operating tube mounted for rotation relative to said body and said closing member for driving said closing member between said two states.

2. The writing device of claim 1, wherein said closing member is rotatable about said cylindrical body axis and said pen tip is disposed eccentrically with respect to said cylindrical body axis.

3. The writing device of claim 1, wherein said operating tube engages said closing member through a first cam groove and follower mechanism, and said closing member engages said writing unit through a second cam groove and follower mechanism, the grooves of said first and second mechanisms being shaped so that said rotation and axial movement of said closing member relative to said body are effected by merely rotating said operating tube relative to said body.

4. The writing device of claim 3, wherein said writing unit is disposed in said closing member which in turn is disposed in said operating tube, said operating tube having said follower of said first mechanism projecting from the inner surface thereof, said closing member having said groove of said first mechanism provided at the outer surface thereof, said closing member further having said follower of said second mechanism on the inner surface thereof, and said writing unit including said groove of said second mechanism at the outer surface thereof.

5. The writing device of claim 3, wherein said writing unit and said operating tube are disposed in said closing member, said operating tube having said groove of said first mechanism at the outer surface thereof, said closing member including said follower of said first mechanism and said groove of said second mechanism being provided at the inner surface thereof, and said writing unit having said follower of said second mechanism at the outer surface thereof.

* * * * *